United States Patent [19]

Duchateau et al.

[11] 4,177,855

[45] Dec. 11, 1979

[54] TUNDISH AND METHOD OF POURING MOLTEN METAL THEREWITH

[75] Inventors: Jean L. Duchateau, Jouy-en-Josas; Bernard E. Sautiere, Sedan, both of France

[73] Assignee: Foseco Trading A.G., Chur., Switzerland

[21] Appl. No.: 891,271

[22] Filed: Mar. 28, 1978

[30] Foreign Application Priority Data

Mar. 28, 1977 [GB] United Kingdom ..... 13002/77
Sep. 2, 1977 [GB] United Kingdom ..... 36753/77

[51] Int. Cl.[2] ..... B22D 11/10

[52] U.S. Cl. ..... 164/82; 164/437; 222/607; 266/275

[58] Field of Search ..... 164/82, 437, 438; 266/275; 222/607

[56] References Cited

U.S. PATENT DOCUMENTS 4,042,229 8/1977 Eccleston ..... 164/82 X

FOREIGN PATENT DOCUMENTS 48-27048 8/1973 Japan ..... 164/437
1364665 8/1974 United Kingdom .
343759 7/1972 U.S.S.R. ..... 164/437

*Primary Examiner*—Robert D. Baldwin
*Attorney, Agent, or Firm*—Cushman, Darby & Cushman

[57] ABSTRACT

The invention is for a method of pouring molten metal from a ladle to another vessel e.g. a mould, via an intermediate vessel e.g. a tundish, and to an intermediate vessel for us in such a method. Before pouring two refractory heat-insulating slabs are positioned in the intermediate vessel spaced apart and extending downwardly into the vessel. The slabs are pivotally mounted at an upper edge or in a wall portion of the intermediate vessel and positioned so that, on pouring the molten metal from the ladle into the space between the slabs, the slabs contain splash of the metal on initial pouring. As pouring is continued the slabs are raised by the molten metal and pivot about their pivotal mounting until they reach a generally horizontal position on top of the molten metal in the intermediate vessel when they form a heat-insulating cover.

26 Claims, 5 Drawing Figures

Figure 1:
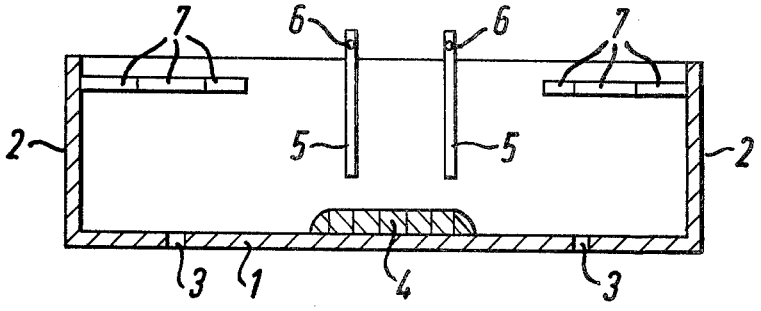

FIG. 4
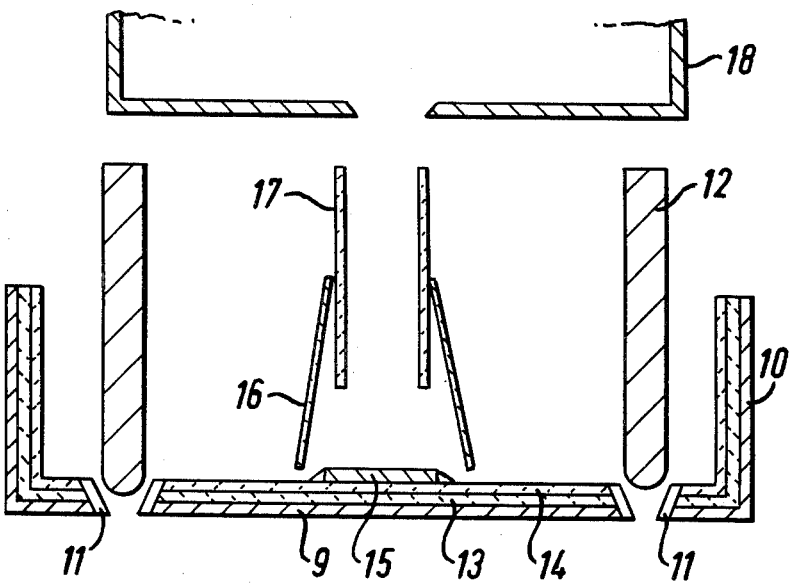
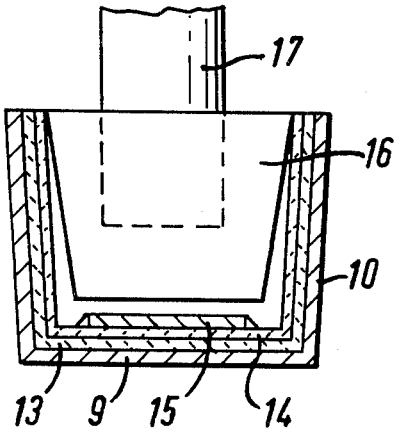
FIG. 5

TUNDISH AND METHOD OF POURING MOLTEN METAL THEREWITH

This invention relates to a method of pouring molten metal from a ladle to another vessel e.g. a mould, via an intermediate vessel e.g. a tundish, in particular in the continuous casting of molten metal such as steel.

According to the invention there is provided a method of pouring molten metal from a ladle to another vessel e.g. a mould, via an intermediate vessel e.g. to tundish, comprising positioning in the intermediate vessel pivotally mounted at an upper edge or in a wall portion thereof, before pouring the molten metal into the intermediate vessel from the ladle, two refractory heat-insulating slabs in spaced apart relation and extending downwardly into the intermediate vessel, and pouring the molten metal from the ladle into the space between the slabs so that the slabs contain splash of the metal on initial pouring, as pouring is continued the slabs being raised by the molten metal to a generally horizontal position on top of the molten metal in the intermediate vessel.

In our U.K. Pat. No. 1,364,665 there is described a tundish comprising an outer metal casing, a permanent lining of refractory material adjacent the casing and an expendable lining made up of a set of slabs of refractory heat insulating material, the impact area of the tundish being lined with highly erosion resistant or sacrificial material. Preferably the intermediate vessel used in the present method is such a tundish, the two refractory heat insulating slabs being pivotally mounted in a position such that molten metal poured into the tundish passes between the pivotally mounted slabs and impacts on the impact area of the tundish.

With the method of the present invention, the pivotally mounted slabs form a cover over at least part of the molten metal in the filled intermediate vessel such as a tundish. In this way loss of heat from the top of the intermediate vessel is reduced. Also the cover helps to retain powder additives added to the molten metal and thus reduces the tendency of the atmosphere surrounding the intermediate vessel to become contaminated with hazardous materials.

Moreover in the initial stage of pouring using the method of the present invention the slabs extend, generally parallel to each other, towards the impact area on the floor of the intermediate vessel. Thus they confine the splash from impact of molten metal on the impact area.

Accordingly splashing when molten metal is first poured into the intermediate vessel is minimised.

The size of the pivotally mounted slabs used in the present invention will be dictated by the internal dimensions of the tundish or other intermediate vessel i.e. the height of the vessel and also its depth. Since in general intermediate vessels such as tundishes tend to be more than twice as long as they are deep, when cover slabs are in horizontal position resting on the molten metal surface, there will tend to be a gap between the end of the vessel and the adjacent edge of the respective slab. This gap may be filled in with further heat insulating cover. Thus, there may be provided one or more further heat insulating slabs which will initially rest on the floor of the intermediate vessel and rise with the level of molten metal in the vessel to form a cover or one or more further heat insulating slabs may be located elsewhere in the vessel e.g. at the predetermined level at which molten metal is to fill the vessel. In this latter case the level of molten metal in the vessel will rise to that of these further slabs on filling. The gap may instead be filled once the molten metal is in position, for example, by using a heat insulating powder or exothermic powder.

The pivotally mounted slabs may be made of an expendable refractory heat insulating material according to the recipe for such material of U.K. Pat. No. 1,364,665. In addition however the slabs may contain exothermic or heat expandible materials, examples being respectively aluminium powder and acid treated graphite. The slabs may be made by known method and my have a density of 0.4 to 1.2 g/cm$^3$.

The invention includes an intermediate vessel, for use in the method of the invention, having two spaced apart refractory heat-insulating slabs, pivotally mounted at an upper edge or in a wall portion thereof, the slabs being movable about said mount from a first position in which they extend downwardly into the vessel, generally parallel to each other, to a second position in which they lie substantially in a common, generally horizontal plane, and also metal when cast by the said method.

In a modification of the method and intermediate vessel of the invention only one of the slabs is pivotally mounted.

Figure 2:
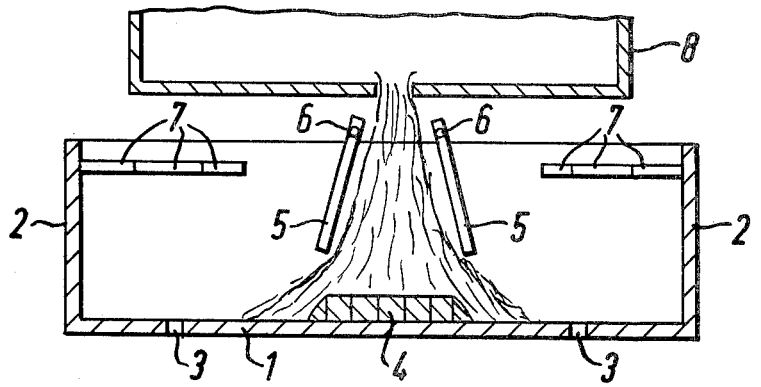
Figure 3:
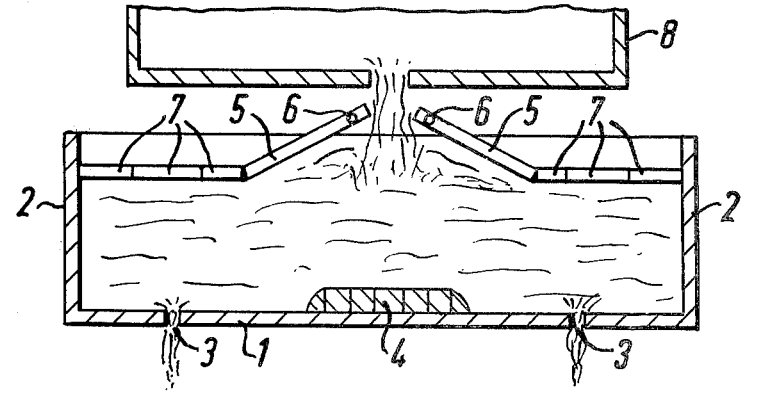

Embodiments of the invention are illustrated in the accompanying diagrammatic drawings in which FIGS. 1 to 3 are sectional views of one form of tundish according to the invention respectively before molten metal is poured into the tundish, at the initial pour stage, and when the tundish has been filled with molten metal; and FIGS. 4 and 5 are sectional views of another form of tundish according to the invention in which pivotally mounted slabs are used in conjunction with a protective pouring tube located between a ladle and the tundish as described in our U.S. Application No. 702,360.

Referring to FIGS. 1 to 3 a tundish comprises an outer metal casing formed of a floor 1 and integral sidewalls 2. Pouring nozzles 3 are set in the floor 1. The casing has a lining (not shown) comprising an outer permanent lining of refractory bricks covered by an expendable lining of slabs of refractory heat insulating material having a high heat insulation value and a low thermal capacity (this structure is described in U.K. Pat. No. 1,364,665). In addition the floor has an impact pad 4 defining a pouring area for the molten metal.

Two refractory heat insulating slabs 5 are located above and to each side of the pad 4. The slabs 5 are pivotally mounted on the upper rim of the tundish casing by bridging hinge bars 6. In the condition shown in FIG. 1, the slabs 5 project from the tundish casing and extend down towards the floor 1. To each side of the slabs 5 is a set of further refractory heat insulating slabs 7 which are supported horizontally within the tundish on the sidewalls. (In transverse cross-section the tundish tapers outwardly upwardly and so the slabs 7 may simply rest on the sidewalls for support). The ends of the slabs 7 closest to the pad 4 are spaced from the bars 6 such that when the tundish is filled (FIG. 3), the adjacent slabs 5 and 7 abut.

The slabs 5 and the slabs 7 may be made by dewatering in a suitably shaped mould an aqueous slurry of the following composition (by weight)

| | |
|---|---|
| Rice husks<br>calcium silicate | 68% |

-continued

| | |
|---|---|
| fibre | 18% |
| wheat flour | 8% |
| paper | 6% |

In use, the slabs 5 and 7 are mounted as shown in FIG. 1. A ladle 8 (FIG. 2) is brought over the tundish and molten metal is poured between the slabs 5 on to the pad 4. The molten metal splashes off the pad and the splashes are contained by opposite faces of the slabs 5. As the level of molten metal rises in the tundish, the slabs 5 pivot about the bars 6 to the condition shown in FIG. 3 and these slabs together with the slabs 7 define a heat insulating cover for the molten metal, save in the area where the metal continues to flow from the ladle. This cover is efficient in heat insulating, and prevents spread of splashing.

Referring to FIGS. 4 and 5 a tundish comprises an outer metal casing formed of a floor 9 and integral side walls 10. Pouring nozzles 11 are set in the floor and located above the pouring nozzles 11 are stopper rods 12.

The casing has a lining comprising an outer permanent refractory lining 13 and an inner expendable lining 14 of refractory heat insulating material of low thermal conductivity and low thermal capacity. The tundish also has an impact pad 15 located on the inner expendable lining in the region where molten metal enters the tundish.

Two refractory heat insulating slabs 16 are located above and to each side of pad 15. The slabs 16 are trapezoidal in shape and are located with their wider end uppermost and the upper corners of the slabs 16 are wedged against the inner expendable lining 14 on the side walls of the tundish.

The upper edge of the slabs 16 rests against the outer wall of a pouring tube of refractory heat insulating material 17. A gap is present between the lower end of the slabs 16 and the floor lining 14.

In use molten metal is poured from a ladle 18 through the tube 17 and onto the impact pad 15. Molten metal splashes off the pad 15 and on to the slabs 16. As the level of molten metal rises in the tundish the slabs 16 rise up with the molten metal to form an essentially horizontal heat insulating cover when the tundish is full.

We claim:

1. A method of pouring molten metal comprising providing an intermediate vessel with at least one nozzle disposed in pouring relationship to another vessel, positioning in the intermediate vessel pivotally mounted at an upper edge or in a wall portion thereof, two refractory heat-insulating slabs in spaced apart relation and extending downwardly into the intermediate vessel, pouring the molten metal from a ladle into the space between the slabs so that the slabs contain splash of the metal on initial pouring, and continuing pouring in such a manner that the slabs are raised by the molten metal to a generally horizontal position on top of the molten metal in the intermediate vessel.

2. A method according to claim 1 in which the pivotally mounted slabs are positioned such that in the generally horizontal position, there is a space between an end of each of these slabs and an adjacent wall of the intermediate vessel and one or both of these spaces is substantially filled by at least one other refractory heat insulating slab.

3. A method according to claim 1 in which the pivotally mounted slabs are positioned such that in the generally horizontal position, there is a space between an end of each of these slabs and an adjacent wall of the intermediate vessel and, before the pouring into this vessel is commenced, at least two other refractory heat-insulating slabs are so placed in the intermediate vessel that, when the pouring into this vessel is continuing, they rest on the surface of the metal and substantially fill the space between the end of each of the pivotally mounted slabs and the adjacent wall of the intermediate vessel.

4. A method according to claim 3, wherein the other slabs are placed on the floor of the intermediate vessel before pouring.

5. A method according to claim 3, wherein before pouring the other slabs are located in the intermediate vessel at the level to which molten metal is to be poured into the vessel.

6. A method according to claim 1 in which the pivotally mounted slabs are positioned such that in the generally horizontal position, there is a space between an end of each of these slabs and an adjacent wall of the intermediate vessel and, when the pouring into this vessel is continuing, a heat insulating or exothermic powder is so placed on the surface of the metal as to cover substantially all the metal surface otherwise exposed between the end of each of the pivotally mounted slabs and the adjacent wall of the intermediate vessel.

7. A method according to claim 1, wherein the intermediate vessel is a tundish comprising an outer metal casing, a permanent lining of refractory material adjacent the casing and an expendable lining made up of a set of slabs of refractory heat insulating material, the impact area of the tundish being lined with highly erosion resistant or sacrificial material, the two refractory heat insulating slabs being pivotally mounted in a position such that molten metal poured into the tundish passes between the pivotally mounted slabs and impacts on the impact area of the tundish.

8. A method of pouring molten metal comprising providing an intermediate vessel with at least one nozzle disposed in pouring relationship to another vessel, positioning in the intermediate vessel two refractory heat-insulating slabs in spaced-apart relation and extending downwardly into the intermediate vessel, one of said slabs being pivotally mounted at an upper edge or in a wall portion of the intermediate vessel, pouring the molten metal from a ladle into the space between the slabs so that the slabs contain splash of the metal on initial pouring, and continuing pouring in such a manner that said one slab is raised by the molten metal to a generally horizontal position on top of the molten metal in the intermediate vessel.

9. A method according to claim 8 in which said one slab is positioned such that in the generally horizontal position, there is a space between an end of said one slab and an adjacent wall of the intermediate vessel and this space is substantially filled by at least one other refractory heat insulating slab.

10. A method according to claim 8 in which said one slab is positioned such that in the generally horizontal position, there is a space between an end of said one slab and an adjacent wall of the intermediate vessel and, before the pouring into this vessel is commenced, at least one other refractory heat-insulating slab is so placed in the intermediate vessel that, when the pouring into this vessel is continuing, it rests on the surface of the metal and substantially fills the space between the end of said one slab and the adjacent wall of the intermediate vessel.

11. A method according to claim 10, wherein the other slab is placed on the floor of the intermediate vessel before pouring.

12. A method according to claim 10, wherein before pouring the other slab is located in the intermediate vessel at the level to which molten metal is to be poured into the vessel.

13. A method according to claim 8 in which the pivotally mounted slab is positioned such that in the generally horizontal position, there is a space between an end of this slab and an adjacent wall of the intermediate vessel and, when the pouring into this vessel is continuing, a heat insulating or exothermic powder is so placed on the surface of the metal as to cover substantially all the metal surface otherwise exposed between the end of the pivotally mounted slab and the adjacent wall of the intermediate vessel.

14. A method according to claim 8, wherein the intermediate vessel is a tundish comprising an outer metal casing, a permanent lining of refractory material adjacent the casing and an expendable lining made up of a set of slabs of refractory heat insulating material, the impact area of the tundish being lined with highly erosion resistant or sacrificial material, the two refractory heat insulating slabs being mounted in a position such that molten metal poured into the tundish passes between the two slabs and impacts on the impact area of the tundish.

15. An intermediate vessel comprising a bottom wall and upstanding side wall structures, at least one pouring nozzle, two spaced apart refractory heat-insulating slabs, pivotally mounted at an upper edge or in a wall portion thereof, said slabs being movable about said mount from a first position in which they extend downwardly into the vessel generally parallel to each other adjacent said bottom wall, to a second position in which they lie substantially in a common, generally horizontal plane.

16. A vessel according to claim 15 in which the pivotally mounted slabs are so dimensioned as to extend across substantially the entire width of the vessel.

17. A vessel according to claim 15 in which the pivotally mounted slabs have a density of 0.4 to 1.2 g/cm$^2$.

18. A vessel according to claim 15 in which the pivotally mounted slabs contain exothermic material.

19. A vessel according to claim 15 in which the pivotally mounted slabs contain heat-expandible material.

20. A vessel according to claim 15 which is a tundish comprising an outer metal casing, a permanent lining of refractory material adjacent the casing and an expendable lining made up of a set of slabs of refractory heat insulating material, the impact area of the tundish being lined with highly erosion resistant or sacrificial material, the two refractory heat insulating slabs being pivotally mounted in a position such that molten metal can be poured into the tundish between the pivotally mounted slabs and impact on the impact area of the tundish.

21. An intermediate vessel comprising a bottom wall and upstanding side wall structures, at least one pouring nozzle two spaced apart refractory heat-insulating slabs, one of which is pivotally mounted at an upper edge or in a wall portion thereof, said one slab being movable about its mounting from a first position in which it extends downwardly into the vessel generally parallel to the other slab and adjacent said bottom wall to a second position in which it lies substantially in a generally horizontal plane.

22. A vessel according to claim 21 in which the pivotally mounted slab is so dimensioned as to extend across substantially the entire width of the vessel.

23. A vessel according to claim 21 in which the pivotally mounted slab has a density of 0.4 to 1.2 g/cm$^2$.

24. A vessel according to claim 21 in which the pivotally mounted slab contains exothermic material.

25. A vessel according to claim 21 in which the pivotally mounted slab contains heat-expandable material.

26. A vessel according to claim 21 which is a tundish comprising an outer metal casing, a permanent lining of refractory material adjacent the casing and an expendable lining made up of a set of slabs of refractory heat insulating material, the impact area of the tundish being lined with highly erosion resistant or sacrificial material, the two refractory heat insulating slabs being in a position such that molten metal can be poured into the tundish between the two slabs and impact on the impact area of the tundish.

* * * * *